US007762401B1

(12) United States Patent
Stone

(10) Patent No.: US 7,762,401 B1
(45) Date of Patent: Jul. 27, 2010

(54) MAIL TEMPLATE FOR MEASURING SIZE AND FLEXIBILITY

(75) Inventor: Bryan J. Stone, Dallas, TX (US)

(73) Assignee: Siemens Industry, Inc., Alpharetta, GA (US)

( * ) Notice: Subject to any disclaimer, the term of this patent is extended or adjusted under 35 U.S.C. 154(b) by 456 days.

(21) Appl. No.: 11/355,211

(22) Filed: Feb. 15, 2006

(51) Int. Cl.
*B07C 5/00* (2006.01)

(52) U.S. Cl. ..... 209/630; 209/942

(58) Field of Classification Search ..... 209/630, 209/942

See application file for complete search history.

(56) References Cited

U.S. PATENT DOCUMENTS 4,963,251 A * 10/1990 Bohm et al. ..... 209/564
6,079,570 A * 6/2000 Oppliger et al. ..... 209/630
6,279,750 B1 8/2001 Lohmann ..... 209/559
6,283,304 B1 9/2001 Gottlieb et al. ..... 209/603
6,655,683 B2 12/2003 Engarto et al. ..... 271/265
2004/0040898 A1 * 3/2004 Kechel ..... 209/584
2004/0113358 A1 6/2004 Engarto et al. ..... 271/262
2004/0245158 A1 * 12/2004 Redford et al. ..... 209/584
2005/0280833 A1 12/2005 Dian et al. ..... 356/630

* cited by examiner

*Primary Examiner*—Patrick Mackey
*Assistant Examiner*—Kalyanavenkateshware Kumar

(57) ABSTRACT

A template according to the invention is configured for manual testing of a mail piece to determine if the dimensions and stiffness of the mail piece are acceptable for passage through an associated automated mail sorting machine. The template includes a frame having a pair of spaced, curved walls defining a curved test slot. The curved slot has an open end through which a mail piece can be inserted and a removal opening for removing the mail piece from the slot. The removal opening in a preferred embodiment comprises a lengthwise slot in one of the curved walls through which the mail piece can be manually held and pushed back out of the open end of the template. The template may include a bracket for mounting the template on a secure surface.

6 Claims, 3 Drawing Sheets

MAIL TEMPLATE FOR MEASURING SIZE AND FLEXIBILITY

TECHNICAL FIELD

The invention relates to mail handling and processing equipment and in particular to a device and method for testing mail pieces to determine if the mail pieces can be processed in automated mail handling equipment without damage to the equipment or the mail piece.

BACKGROUND OF THE INVENTION

The United States Postal Service (USPS) relies on automated sorting machines to process millions of pieces of mail on a daily basis. One such machine is the DIOSS (Delivery Bar Code Sorter/Optical Character Reader/Input Subsystem/Output SubSystem) D mail sorting machine which is used by USPS to mechanically sort various types and sizes of mail. The machine uses optical character recognition software (OCR) to read address information and redirects mail based on that information. The machine operates for up to 20 hours a day with a crew of two to three people and sorts mail at rates of approximately 16,000 to 34,000 pieces per hour.

The DIOSS D mail sorting machine is capable of sorting mail with a maximum size of 292 millimeters (mm) long×165 millimeters (mm) wide×12.7 millimeters (mm) thick. Acceptable mail must also meet flexibility requirements within the specified envelope of size. Unacceptable mail that is permitted to run through the DIOSS D will sustain damage or will damage the mail sorting machine. Currently, however, the size and of flexibility of mail pieces is not measured during the sorting process. No standard template exists to test and qualify the range of mail capable of running through the DIOSS D mail sorting machine.

A number of automated systems have been developed for testing the stiffness and/or thickness of mail pieces during or at the start of passage of the mail pieces through the automated mail processing equipment. One such device is disclosed in commonly assigned pending Redford et al. United States Patent Application 20040245158, Dec. 9, 2004. See also U.S. Pat. Nos. 6,079,570, 6,279,750, 6,283,304, 6,655,683 and U.S. Patent Publications 20030127792 and 20040113358. Such devices have, however, must be retrofit or built into the sorting machine itself, and are designed to test all mail pieces processed through automated sorting equipment, rather than allow an operator to selectively test questionable mail pieces on an individual basis.

To manually determine the flexibility and size of a mail piece, an operator would normally use two separate devices, for example, a ruler and a force gauge. Taking two such separate measurements is cumbersome and time consuming. Due to the time constraints at USPS mail handling and sorting facilities, the testing steps required to verify that questionable mail can be processed without damage to the mail piece or the machine are omitted at the sorting machine. The present invention combines size and flexibility measurements into one test. The simplicity of the template promotes use of the template when operating the DIOSS D, resulting in less damage to the mail and machine. The reduction in time and damage realized through the use of the template will directly translate into savings to the customer.

SUMMARY OF THE INVENTION

A template according to the invention is configured for manual testing of a mail piece to determine if the dimensions and stiffness of the mail piece are acceptable for passage through an associated automated mail sorting machine. The template includes a frame having a pair of spaced, curved walls defining a curved test slot. The curved slot has an open end through which a mail piece can be inserted and a removal opening for removing the mail piece from the slot. The removal opening in a preferred embodiment comprises a lengthwise slot in one of the curved walls through which the mail piece can be manually held and pushed back out of the open end of the template. The template may include a bracket for mounting the template on a secure surface.

The dimensions of the template are predetermined or preselected such that a mail piece that too large or too stiff to be acceptable for passage through the associated automated mail sorting machine will not fully fit in the curved slot or will fail to conform to the curvature of the slot. Acceptable dimensions and/or stiffness are determined based upon the minimum radius that the mail piece must traverse during automated processing and the maximum length, width and height of mail pieces that can be processed in the automated sorting machine. For purposes of the invention, a mail piece is considered to fail to conform to the curvature of the slot if (1) it becomes stuck when insertion in the curved slot is attempted, or (2) can be fully inserted and removed from the slot only using substantially more force that a typical mail piece sorted on the mail sorting machine, or (3) is damaged when insertion in the curved slot is attempted.

In another aspect, a method according to the invention to determine if the stiffness and thickness are acceptable for passage through an automated mail sorting machine includes selecting a mail piece for testing and inserting the mail piece into an end of a curved slot defined by a template. The template is designed to the maximum dimensions acceptable for the associated sorting machine and has a curvature such that mail pieces that cannot conform to such curvature are excessively stiff and are not acceptable for processing through the sorting machine. If the mail piece fails to fit into the slot due to its dimensions or cannot conform to the curvature of the slot, it is rejected. Otherwise the mail piece is accepted for processing and fed into the automated mail sorting machine. If the mail piece tested is one of a batch of like size mail pieces, the entire batch may be accepted or rejected based on the result of the test. Mail pieces to be tested may be manually selected based on being representative of a series of like sized mail pieces to be sorted and/or if the mail piece is visually judged to be of greater dimensions that other mail pieces in a batch.

BRIEF DESCRIPTION OF THE DRAWINGS

In the accompanying drawings, wherein like numerals represent the same or similar elements throughout.

DETAILED DESCRIPTION

Figure 1:
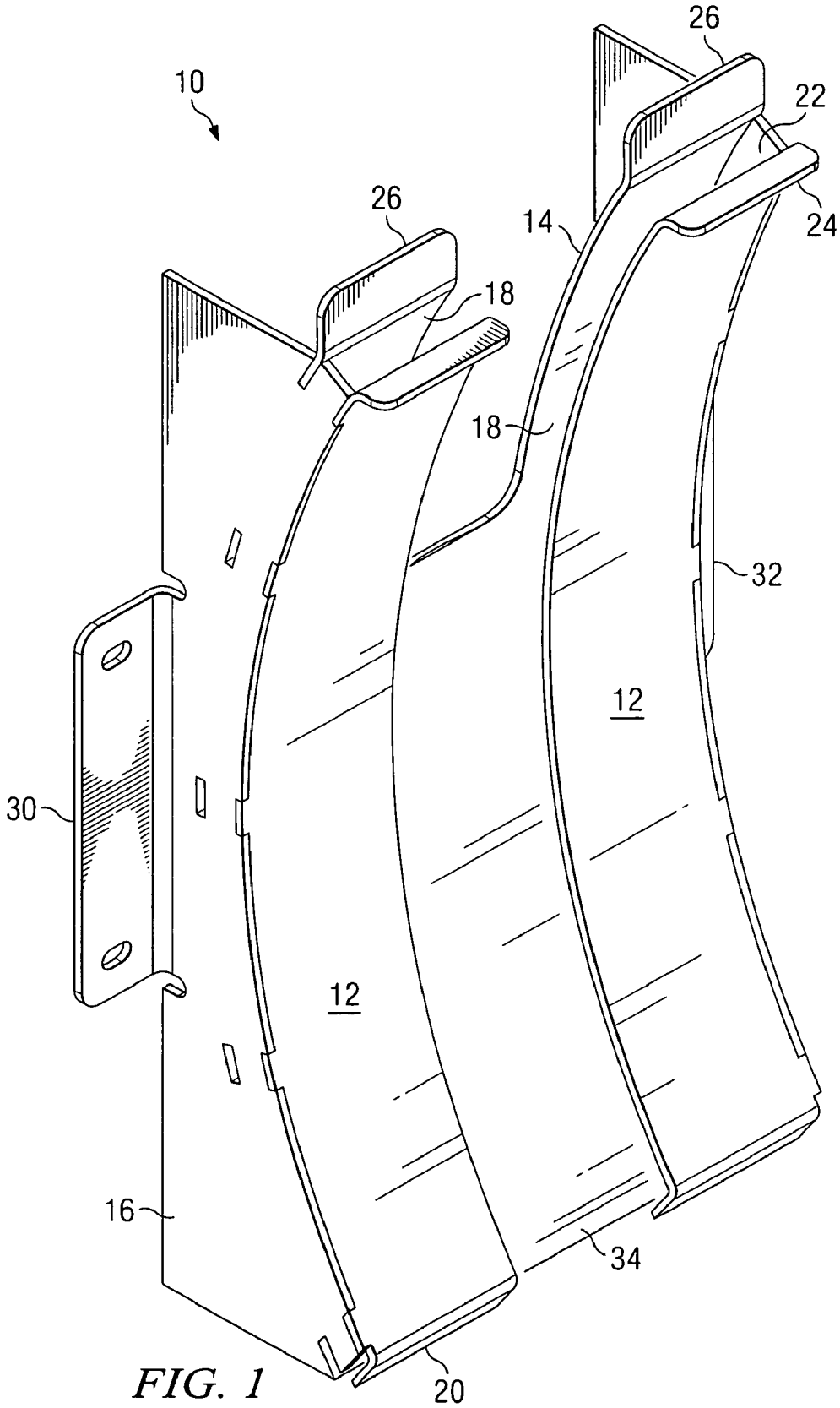
FIG. 1 is a partial perspective view of a template according the invention.
Figure 2:
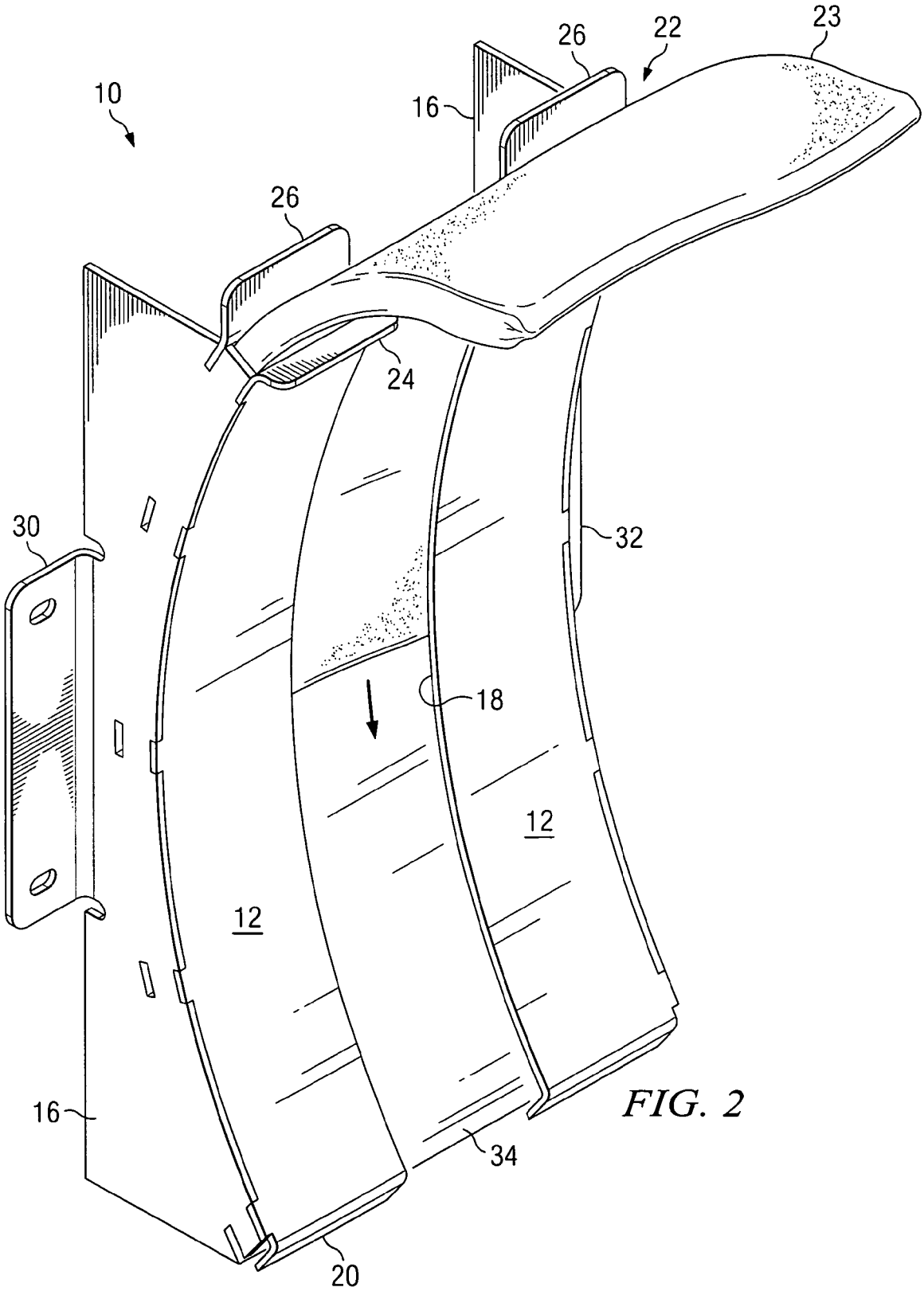
FIG. 2 is a partial perspective view of the template of FIG. 1 illustrating a mail piece inserted in the template for testing.
Figure 3:
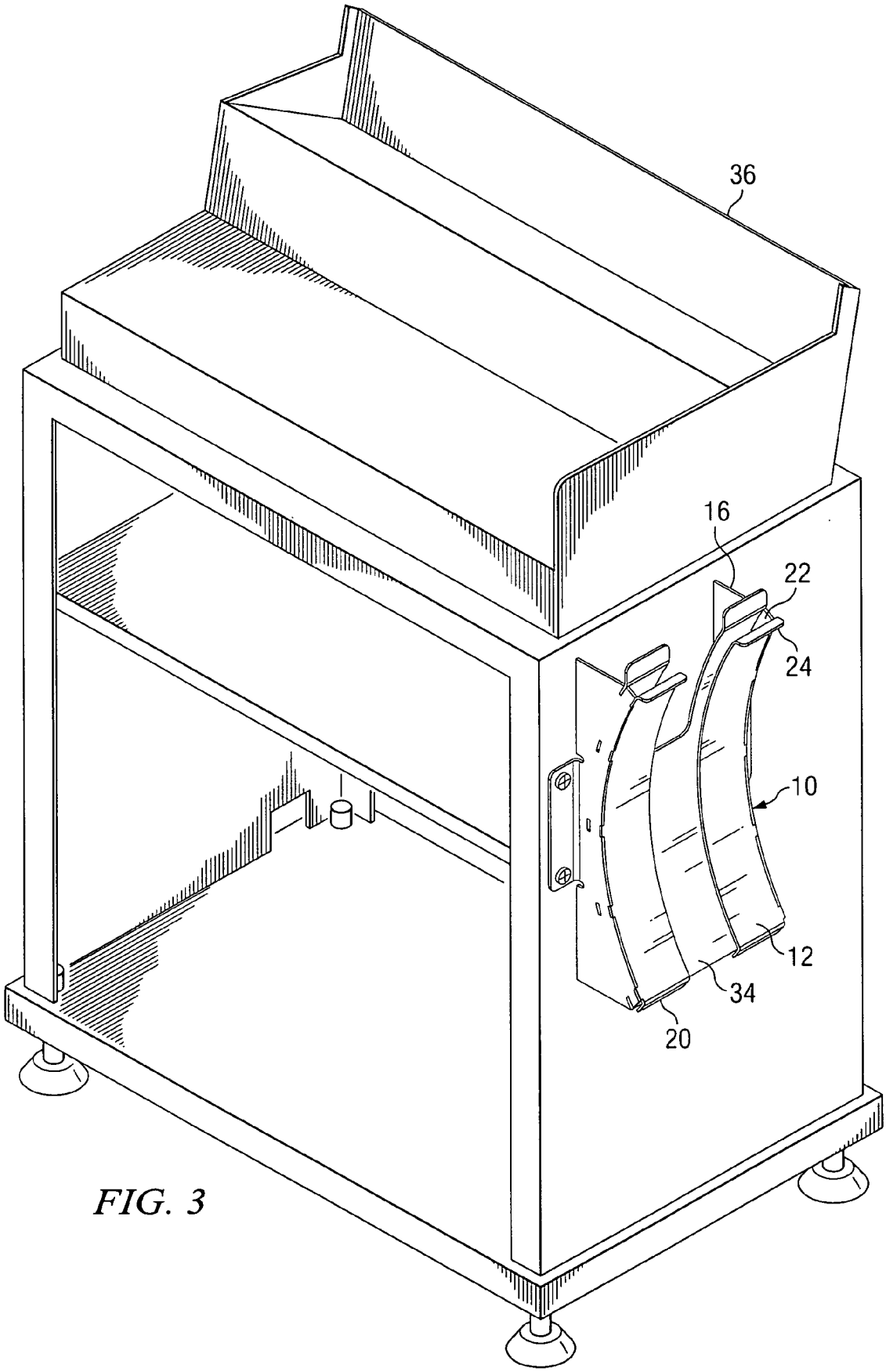
FIG. 3 is a partial perspective view of the template of FIG. 1 mounted on a work table or bench.

Referring to FIGS. 1-3 a mail template 10 for testing mail pieces prior to feeding the mail pieces to a sorting machine includes front and rear walls 12 and 14 and sidewalls 16 that define a curved slot 18 with a lower closed end 20 and an upper open end 22. As shown in FIG. 2, a mail piece 23 is manually inserted through upper open end 22 into slot 18 to determine if the mail piece is suitable for processing in an automated sorting machine such as a DIOSS. Mail pieces are guided into upper open end 22 of slot 18 by outwardly flared flanges or guides 24 and 26 formed at the upper ends of walls 12 and 14 respectively. A pair of brackets 30 and 32 extend from sidewalls 16 of template 10 for mounting the template on a suitable surface near the sorting machine by any suitable means, such as with screws. In this embodiment, template 10 is manufactured from formed and welded sheet steel components.

Mail template 10 functions by simulating the smallest continuous radius curve in the mail path of an automated mail processing machine, for example, a DIOSS D mail sorting machine. The simulation is accomplished by inserting a mail piece into slot 18. Slot 18 is designed to represent the constraining geometry mail pieces must conform to while traversing the smallest radius in the sorting machine. A slot or removal opening 34 formed in front wall 12 runs from the top to the bottom and through the center of the wall 12. Removal opening 34 allows the user to remove a mail piece 23 from template 10 by pushing the mail piece from the bottom rather than pulling the mail price from the top. Since users with large hands may have difficulty pulling mail pieces from template 10, removal opening 34 offers an alternative method to remove mail from the template.

In one embodiment, upper open end 22 includes flanges 24, 26 that are 2.7 mm long for guiding mail pieces into an insertion slot 18 with dimensions of 165 mm wide×12.7 mm deep. Slot 18 has a depth equivalent to the maximum allowable length for acceptable mail for a DIOSS D mail sorting machine, for example 292.1 mm. In this embodiment, slot 18 follows an 80.5 degree arc with a 201.5 mm inside radius. Front and rear walls 12 and 14 are positioned with a continuous 12.7 mm gap between each other over the entire height of the walls. Mail pieces are inserted into slot 18 until the back end of the mail piece contacts the closed end 20 of the slot. Thus, the upper end of a mail piece having up to the maximum allowable length for processing will sit below or flush with upper open end 22 of slot 18 providing a clear indication if the mail piece in the template is safe for sorting.

Template 10 may be scaled up or down for a variety of mail specifications and/or minimum machine radii as follows: Measurement Angle=(360°×Maximum Mail Length)/(2π (Minimum Radius+(Maximum Mail Thickness×0.5)) where the Minimum Radius equals the smallest radius of the mail path in the sorting machine plus the thickness of the transport belt and the Maximum Radius equals the smallest radius of the mail path plus the thickness of the transport belt plus the maximum allowable mail piece thickness.

Thus, for an application having a maximum mail length of 292.1 mm, a maximum mail thickness of 12.7 mm, a minimum radius of 200 mm and a belt thickness of 1.5 mm, the measurement angle is calculated as follows:

Maximum Mail Length=292.1 mm;

Minimum Radius=200 mm+1.5 mm=201.5 mm

Maximum Radius=200 mm+1.5 mm+12.7 mm=214.2 mm

Measurement Angle=(360°×292.1 mm)/(2*3.14(201.5 mm+(12.7×0.5))=80.5°

In this example, the included angle of slot 18 between upper open end 22 and closed end 20 will be approximately 80° and the depth of slot 18 will be 12.7 mm. The length of slot 18 will be approximately 292.1 mm, corresponding to the maximum allowable mail piece length. For many applications, the radius of outer wall 14 will between 200 mm and 225 mm, the slot width will be between 10 mm and 15 mm and the included angle between upper open end 22 and closed end 20 of slot 18 will be 70 to 90 degrees.

Referring to FIG. 3, template 10 is shown mounted on a mail preparation table 36. Mail preparation table 36 is designed to provide an intermediate work station adjacent to or between a mail cart or conveyor and the feeder of the automated sorting machine. The modular design of template 10 enables the template to be conveniently mounted on the side of table 36 or a similar surface for easy operator access and use.

Mail template 10 provides convenient and objective measurement of allowable length and width. A fully inserted mail piece that protrudes past upper open end 22 of the template or a mail piece that is too wide to insert into slot 18 is clearly outside the processing capability of the sorting machine. The measurement of thickness and flexibility is however, dependent on the machine operator.

The operator will judge flexibility and thickness based on the amount of force needed to insert and remove the mail piece. The force required to test a mail piece will vary with friction and compression within the fixture. With training and practice, an operator will be able to judge when a mail piece is too stiff or too thick to process in an automated sorting machine.

Since the mail template of the invention has no moving parts, it does not require maintenance and the module design of the template provides for easy mounting to a work table, bench or machine surface. The template enables rapid testing of questionable mail pieces prior to introducing the mail pieces into an automated sorting machine.

Although the invention has been illustrated in the accompanying drawing and described in the foregoing detailed description, it will be understood that the invention is not limited to the embodiments disclosed but, as will be appreciated by those skilled in the art, is susceptible to numerous modifications and variations without departing from the spirit and scope of the invention as hereinafter claimed.

The invention claimed is:

1. A method for testing a mail piece to determine if its dimensions and stiffness are acceptable for passage through an automated mail sorting machine, comprising:

manually selecting a mail piece for testing;

manually inserting the mail piece into one end of a curved slot defined by a template, wherein the template has a pair of spaced front and rear walls and sidewalls that define a curved slot, and an open upper end through which the mail piece for testing is manually inserted, which curved slot is configured to reflect maximum dimensions acceptable for the associated sorting machine and having a curvature such that mail pieces that cannot conform to such curvature are excessively stiff and therefore not acceptable for passage through the sorting machine;

rejecting the mail piece if it fails to fit into the slot due to its dimensions or cannot conform to the curvature of the slot; and feeding the mail piece into the sorting machine if it is not rejected.

2. The method of claim 1, wherein the template is mounted on a vertical surface adjacent a work table.

3. The method of claim 1, further comprising manually removing the mail piece from the template through the open upper end of the template.

4. The method of claim 1, wherein the template has no moving parts.

5. A method for testing a mail piece to determine if its dimensions and stiffness are acceptable for passage through an automated mail sorting machine, comprising:

manually selecting a mail piece for testing from a batch of mail pieces presented on a work surface;

manually inserting the selected mail piece into one end of a curved slot defined by a template having a pair of spaced front and rear walls and sidewalls that define the curved slot, and an open upper end through which the mail piece for testing is manually inserted, the curved slot being configured to reflect maximum dimensions acceptable for the associated sorting machine and having a curvature such that mail pieces that cannot conform to such curvature are excessively stiff and therefore not acceptable for passage through the sorting machine, which template is a fixture mounted proximate the work surface;

removing the mail piece from the curved slot through the open upper end;

rejecting the mail piece if it fails to fit into the slot due to its dimensions or cannot conform to the curvature of the slot; and feeding the mail piece into the sorting machine if it is not rejected.

6. The method of claim 5, wherein the template is mounted on a vertical surface at a work table which provides the work surface.

* * * * *